US008757075B2

(12) United States Patent
Brunner et al.

(10) Patent No.: US 8,757,075 B2
(45) Date of Patent: Jun. 24, 2014

(54) HOOK SYSTEM FOR A SEWING MACHINE

(75) Inventors: Severin Brunner, Steckborn (CH); Niklaus Wacker, Steckborn (CH); Hans Fluckiger, Oetwil am See (CH); Georg Janouschek, Steckborn (CH); Andre Stucki, Steckborn (CH)

(73) Assignee: BENINA International AG, Steckborn (CH)

( * ) Notice: Subject to any disclaimer, the term of this patent is extended or adjusted under 35 U.S.C. 154(b) by 28 days.

(21) Appl. No.: 13/415,075

(22) Filed: Mar. 8, 2012

(65) Prior Publication Data

US 2013/0199429 A1 Aug. 8, 2013

(30) Foreign Application Priority Data

Feb. 2, 2012 (CH) ..... 0146/12

(51) Int. Cl.
*D05B 57/14* (2006.01)

(52) U.S. Cl.
USPC ..... 112/181

(58) Field of Classification Search
USPC ..... 112/228, 229, 230, 231, 181, 182, 189
See application file for complete search history.

(56) References Cited

U.S. PATENT DOCUMENTS

| | | | | |
|---|---|---|---|---|
| 780,725 | A | 1/1905 | Noble | |
| 2,065,349 | A | 12/1936 | Southam et al. | |
| 2,295,511 | A | 9/1942 | Barron | |
| 2,428,027 | A | 9/1947 | Ivandick | |
| 2,784,690 | A | 3/1957 | Brandt | |
| 4,137,858 | A * | 2/1979 | Stapel et al. | 112/181 |
| 5,152,236 | A * | 10/1992 | Hirose | 112/231 |
| 5,921,192 | A * | 7/1999 | Badillo | 112/231 |
| 6,076,477 | A * | 6/2000 | Badillo | 112/231 |
| 6,112,684 | A * | 9/2000 | Papajewski | 112/185 |

FOREIGN PATENT DOCUMENTS

| | | |
|---|---|---|
| CH | 256802 | 7/1947 |
| DE | 927250 | 5/1955 |
| JP | 5128049 | 3/1976 |
| JP | 63111882 | 7/1988 |

* cited by examiner

*Primary Examiner* — Danny Worrell
(74) *Attorney, Agent, or Firm* — Volpe and Koenig, P.C.

(57) ABSTRACT

For the continuous drive of a hook of a sewing machine, two drive cams (17) alternately engage in the back of the hook. During the passing of the upper thread loop, the respective drive cam (17) on which the thread would get hung up is out of engagement. The hook is situated in a conical hook race guide and is held therein by magnets.

10 Claims, 11 Drawing Sheets

67
61
61
59
61
41

HOOK SYSTEM FOR A SEWING MACHINE

CROSS-REFERENCE TO RELATED APPLICATIONS

This application claims the benefit of Swiss Patent Application No. 00146/12, filed Feb. 2, 2012, which is incorporated herein by reference as if fully set forth.

BACKGROUND

The subject matter of the present invention is a hook system for a sewing machine.

Hook systems are known. The hook system of the sewing machine guides the upper thread around the lower thread so that a knot can be formed.

The present hook system is a hook system that makes possible a CB-hook-type knot formation. In such hook systems, the upper thread loop, which is guided around the lower thread, is not rotated or twisted; rather, the upper thread runs around the lower thread in a U shape and consequently pulls the lower thread untwisted into the sewed material at the underside. In order to be able to do this, the loop of the upper thread must be guided around the hook body, with the bobbin and the bobbin case situated therein, by the hook tip. This means that the hook body, or hook for short, is not connected to the hook driver via a shaft, but rather is freely mounted in a hook race, and can be set into rotation by the hook driver using suitable means. The further problem occurs here that the upper thread and also the lower thread are braked in irregular fashion by the elements of the hook system, so that changes in thread tension caused by this are detectable later in the stitch pattern.

In such hooks mounted freely in a hook race, there is also the problem that the upper thread, or the upper thread loop, can become clamped between the hook and the hook race during the guiding through. In order to make it possible to release the clamped thread, currently the hook has to be removed from the hook race. This is laborious for the operator, and requires a certain degree of dexterity.

In the known hook systems, there is the further problem that the lower thread, which is pulled into the sewed material by the upper thread, briefly accelerates the lower thread bobbin, so that an overrun of the lower thread cannot be avoided. This causes changes in the thread tension that can again result in a non-optimal stitch pattern.

SUMMARY

Therefore, an object of the present invention is to create a hook system that enables the upper thread loop to be pulled off, or pulled into the material being sewed, with as little friction as possible, or with as constant a level of friction as possible.

A further object of the present invention is to increase the sewing speed, i.e. the number of stitches per time unit, and to minimize the production of noise despite the higher stitch count.

A further object of the present invention is to counteract the clamping of the upper thread in the hook race, and, should a thread nonetheless become clamped, to make it easily releasable from the hook race.

A further object of the present invention is to compensate, to the greatest degree possible, the changes in thread tension caused by the necessarily jerky pulling on the lower thread.

These objects are achieved by hook systems according to the features of the invention.

According to the present invention, the upper thread loop can successfully be guided untwisted around the hook, and thus also around the bobbin case and the bobbin mounted therein, in circulating fashion, i.e. circulating in only one direction of rotation. Through the alternating and, between the alternations, simultaneous engagement of at least two drive cams in the back of the hook body, this body is on the one hand driven continuously while on the other hand space is always created for the frictionless passage of the upper thread loop between the hook and the bobbin case.

The conical design of the hook race for the hook, in combination with an elastically acting axial guiding of the hook in the hook race, makes it possible to release a clamped upper thread without disassembling the hook.

Using a spring that is situated between the bobbin on the bobbin case and is pivotable along the circumference of the bobbin case, changes in the take-off speed of the thread and tension peaks on the lower thread are compensated.

Using a lubricating element, the drive cams can be permanently lubricated, thus preventing wear thereof and increased noise caused thereby.

BRIEF DESCRIPTION OF THE DRAWINGS

The present invention is explained in more detail on the basis of illustrated exemplary embodiments.

DETAILED DESCRIPTION OF THE PREFERRED EMBODIMENT

For clarity, the representation of the sewing machine has been omitted in the Figures. Likewise, the drive means for the hook driver, e.g. the main shaft in the lower arm of the sewing machine, are not shown. These have long been known from the prior art.

Figure 1A:
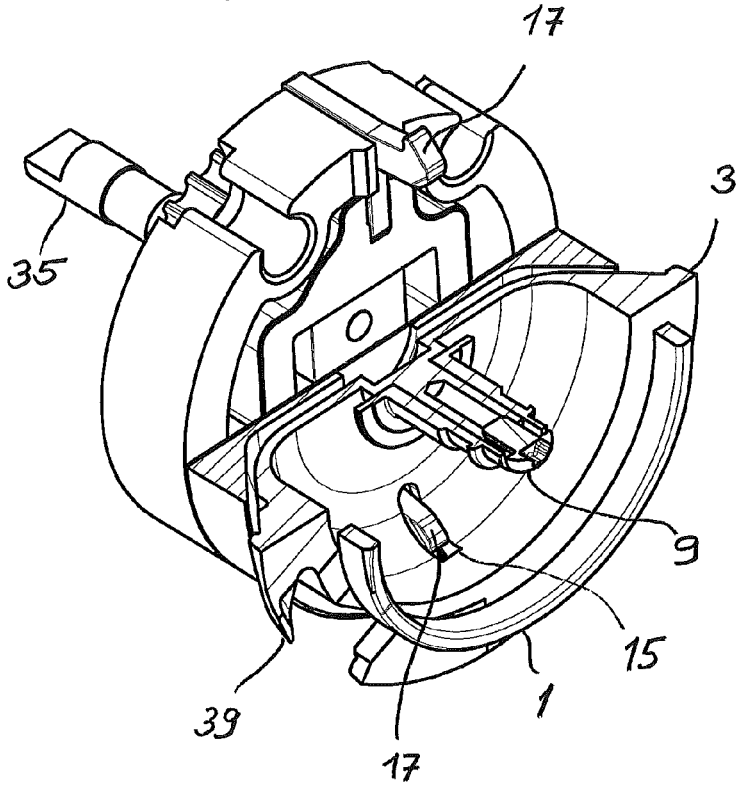
FIG. 1*a* shows a perspective view of a hook driver and, in diagonal section, a hook, with drive cams situated vertically one over the other.
Figure 1B:
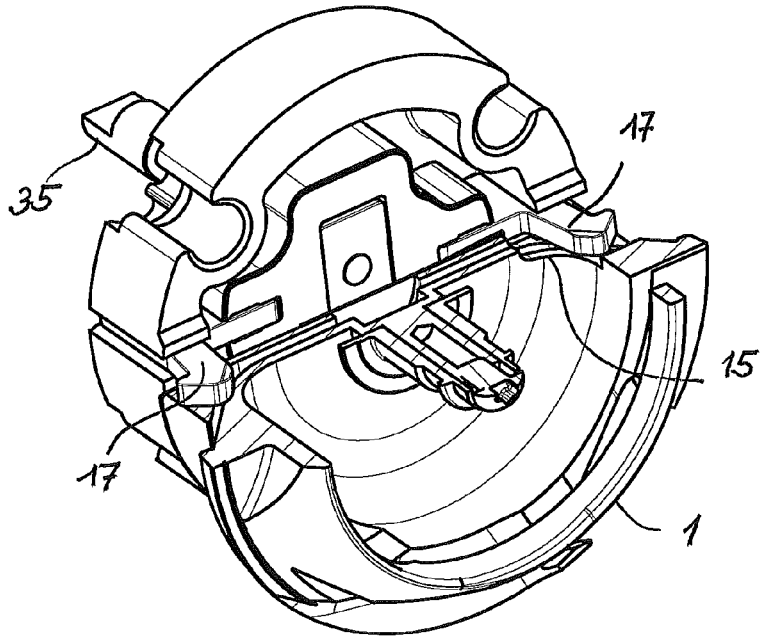
FIG. 1*b* shows the same view as FIG. 1*a*, but with drive cams horizontally alongside one another.
Figure 2:
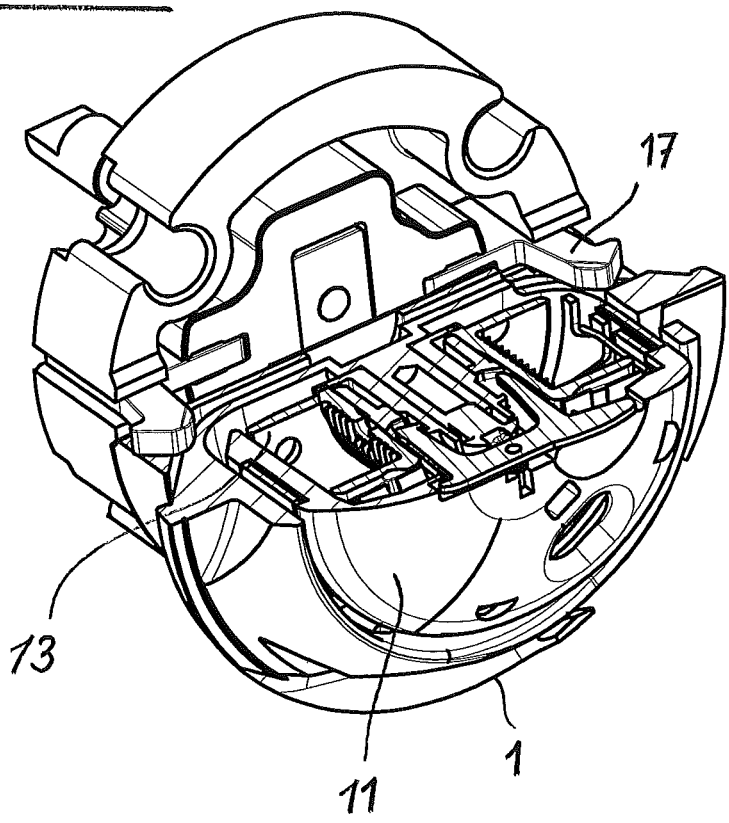
FIG. 2 shows a perspective view of a hook driver and, in diagonal section, a hook with bobbin case set in place and bobbin, diagonally sectioned.

Specifically shown are, in the foreground of FIGS. 1*a*, 1*b*, and 2, in a sectional representation: a hook body, or hook 1, rotatably mounted with its peripheral edge 3 in a hook race 5 visible in other Figures. The hook race 5 is fashioned on a hook race carrier 7 that is fastened in the lower arm (not shown) of the sewing machine. In the hook 1, fashioned in the shape of a bowl, above and below a receiving peg 9 for receiving a bobbin case 11 with lower thread bobbin 13 capable of being placed therein, there is fashioned an opening 15 that penetrates the back 14 of hook 1 completely or partly from the rear side, in which a respective drive cam 17 can engage. The two openings 15 are preferably situated not precisely diagonally to one another, but rather with an offset, in order to prevent incorrect placement of hook 1 into hook race 5. They can also be situated diagonally to one another, in which case the openings 15 are then preferably fashioned with a different width, again so that incorrect placement of hook 1 is impossible.

Drive cams 17 are situated on a cam support 19 that is displaceably guided in a guide bearing 21, which is e.g. disk-shaped. Guide bearing 21 is situated so as to be capable of rotation and capable of being driven on a shaft 35 that is placed in rotationally fixed fashion in the lower arm of the sewing machine. In the depicted example, in the guide bearing 21 there are fashioned two diagonally situated slots 23 in which the two drive cams 17 are guided so as to be essentially radially displaceable.

Figure 3:
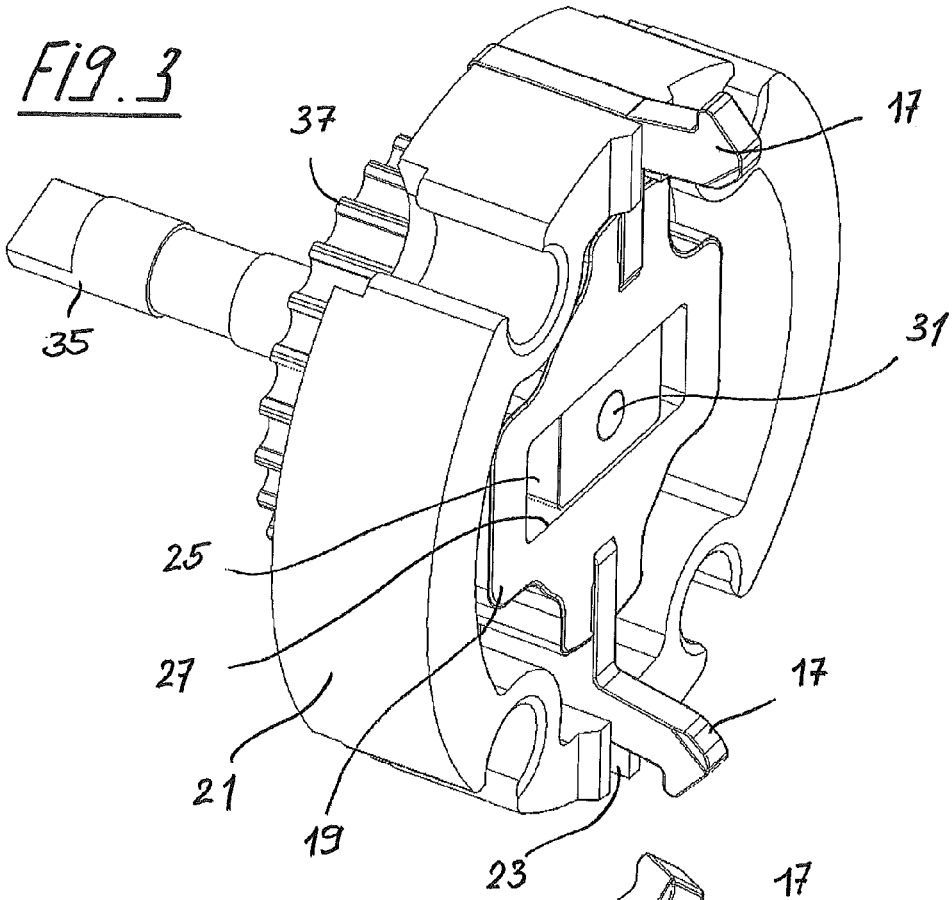
FIG. 3 shows a perspective view of the hook driver.
Figure 4:
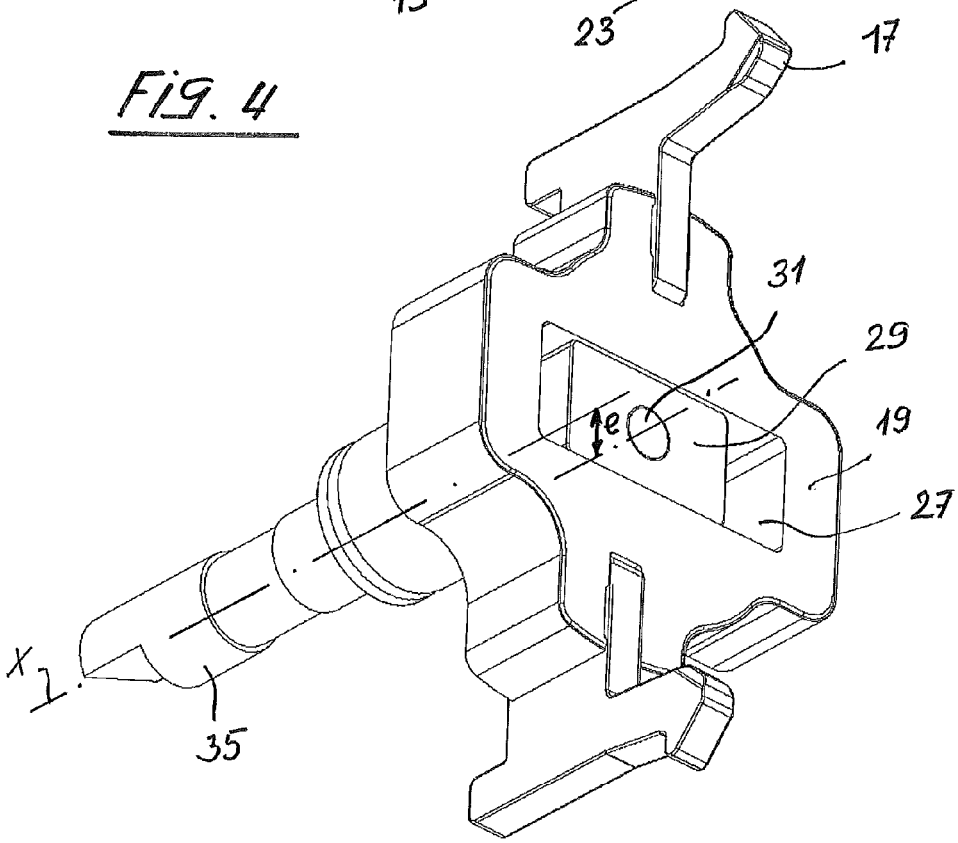
FIG. 4 shows a perspective view of the radially displaceable drive cams in the hook driver.
Figure 5:
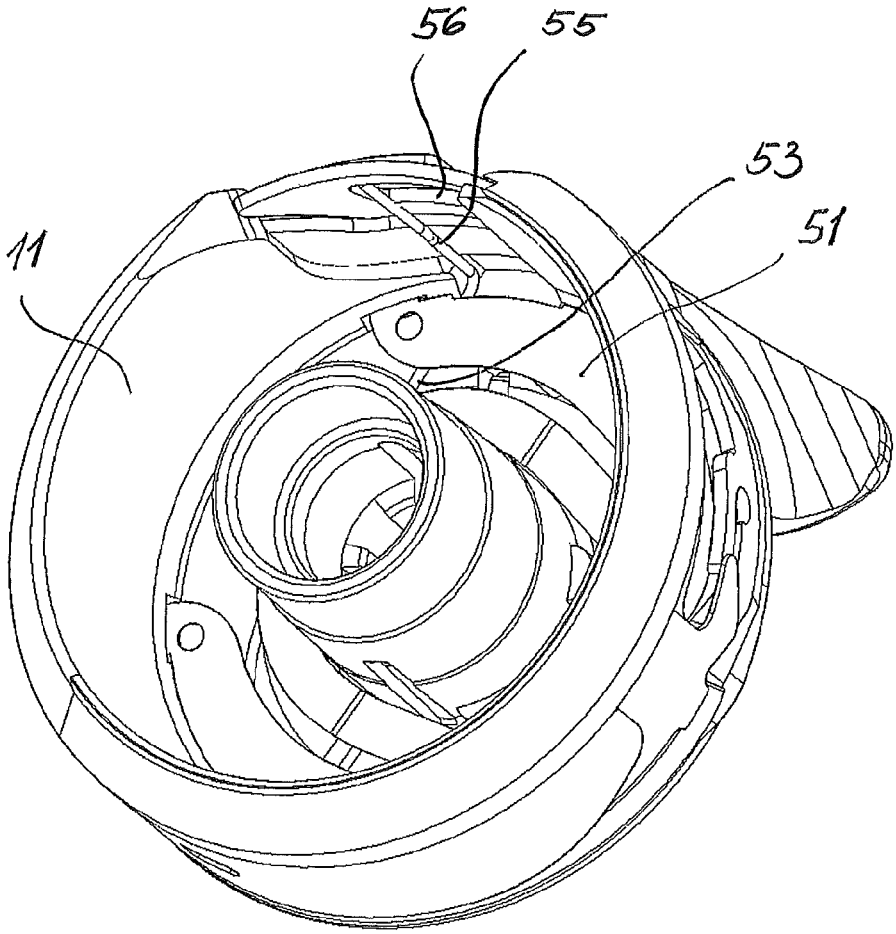
FIG. 5 shows a perspective view of the bobbin case without bobbin and with a brake spring.
Figure 6:
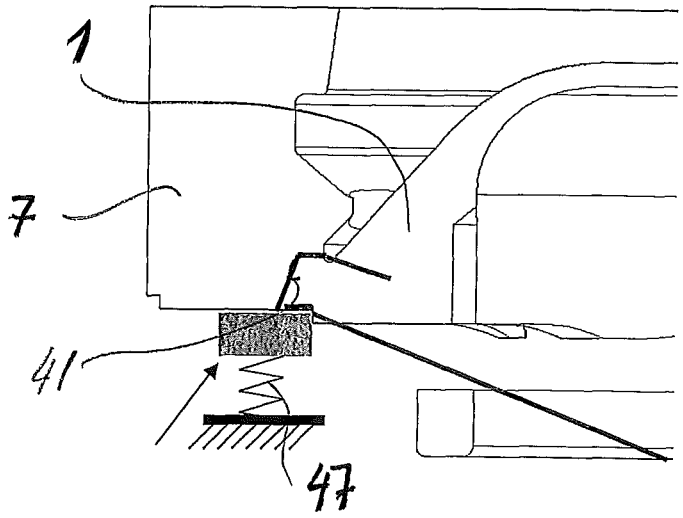
FIG. 6 shows an axial horizontal section through the hook race carrier for the hook, as well as the spring-loaded hook race cover, with clamped upper thread.
Figure 7:
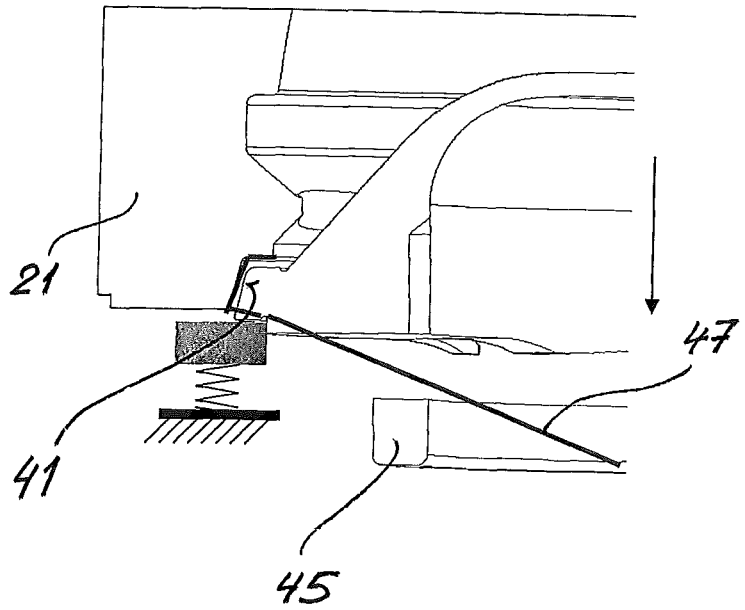
FIG. 7 shows an axial horizontal section through the hook race carrier for the hook, as well as the spring-loaded hook race cover during pulling out of the clamped upper thread.

In the cam support 19, a centrally situated opening 25 is further fashioned in two guide surfaces 27 that run parallel to one another. Between the guide surfaces 27, a sliding block 29 is placed in the opening 25 that can be moved back and forth between the two guide surfaces 27, guided with a small amount of play. The sliding block 29 is supported in its center by a bolt 31. The bolt 31 is connected to the front end of the shaft 35. The bolt 31 is fastened on the end face of shaft 35, eccentrically to axis of rotation X (see FIGS. 3 and 4).

The guide bearing 21 is seated so as to be capable of rotation and capable of being driven on non-rotatable shaft 35. The drive of the guide bearing 21 is explained below. The rotation of guide bearing 21 on shaft 35 causes cam support 19 to move back and forth. The sliding block 29, mounted rotatably on bolt 31, causes cam support 19 to move drive cams 17 in alternating fashion radially into and out of openings 15 on the back 14 of hook 1. In the intermediate positions between the upper and lower end positions of bolt 31, situated eccentrically to axis X of shaft 35, the two drive cams 17 are simultaneously engaged with both slots 15. This means that, independent of the angle of rotation of guide bearing 21, hook 1 is uninterruptedly in positive connection with drive cams 17, and is therefore continuously driven.

In order to enable the hook 1 to be driven with the drive cams 17, or to bring it into driven connection, the guide bearing 21 is for example set into rotation via a gear 37 that is mounted so as to be freely rotatable on stationary shaft 35, and is fixedly connected on the back of the guide bearing 21. The gear 37 is preferably driven by the main shaft.

During operation, in a known manner catch tip 39 on hook 1 forms an upper thread loop and guides it around the hook 1. The eccentric drive for the hook 1 is set such that the drive cam 17 in the region of the upper end position of the hook 1 is lowered in the moment of the passing through of the thread loop; i.e., it moves out of engagement with the hook 1. The upper thread loop can in this way slide through between a conical guide race 41 in which the hook 1 is rotatably mounted. In the angular region in which the one drive cam 17 is out of engagement with hook 1, the other drive cam 17, situated approximately opposite, moves into the other slot 15 and during this time solely takes over the positive transmission of the rotational movement to hook 1.

As soon as the upper thread loop has left the hook 1, the drive cam 17, which previously was still not engaged, again travels into the slot 15. Both of the drive cams 17 are now temporarily engaged on the hook 1.

In order on the one hand to guarantee operation with as little wear as possible, and on the other hand to make operation as low-noise as possible, on the inner side between the guide bearing 21 and the hook 1 there is situated a lubricating element 63 that lubricates the parts of the drive cams 17 that come into contact with the walls or side surfaces in the openings 15. The lubricating element 63 can for example be placed on or in a carrier disc 65, in such a way that some lubricant is dispensed onto the drive cams 17 during each advance and retreat of the drive cams 17. The carrier disc 65 can be fashioned as an exchangeable wearing part that can be exchanged after a specifiable time of use of the sewing machine. The lubricating element 63 is for example a felt panel placed into the support disc 65 or fastened thereon. Preferably, the felt panel is accessible from the hook side, and oil can be dripped onto it.

Figure 8:
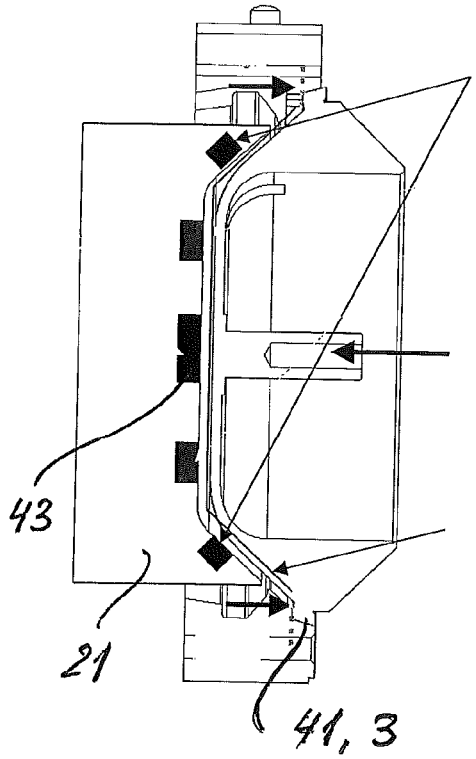
FIG. 8 shows a schematic view of the holding magnets for the hook in the guide bearing.
Figure 9:
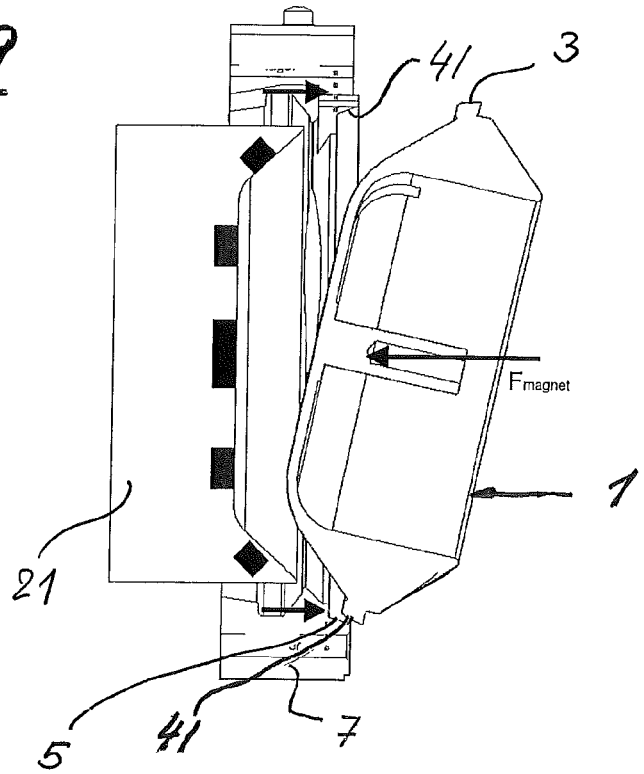
FIG. 9 shows a schematic view of the holding magnets for the hook with partially removed hook.
Figure 10:
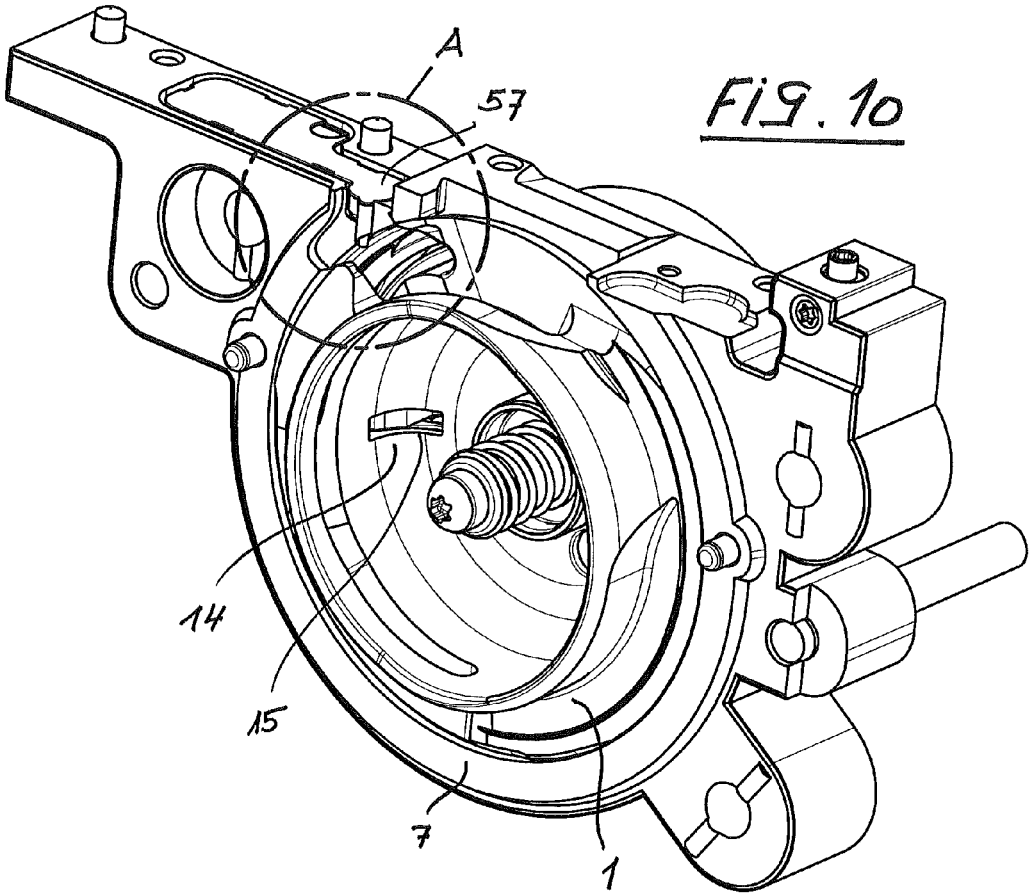
FIG. 10 shows a perspective view of the hook race carrier with oil reservoir for the hook race lubrication.
Figure 10A:
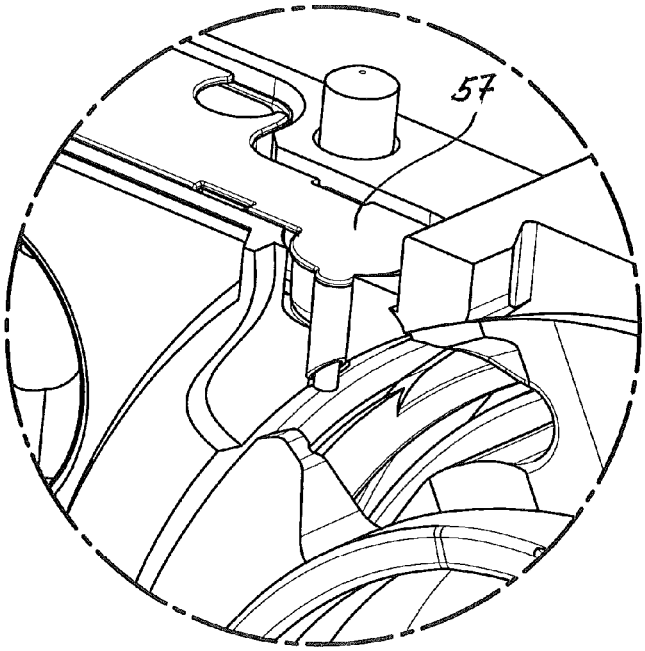
FIG. 10*a* shows an enlargement of segment A in FIG. 10.
Figure 11:
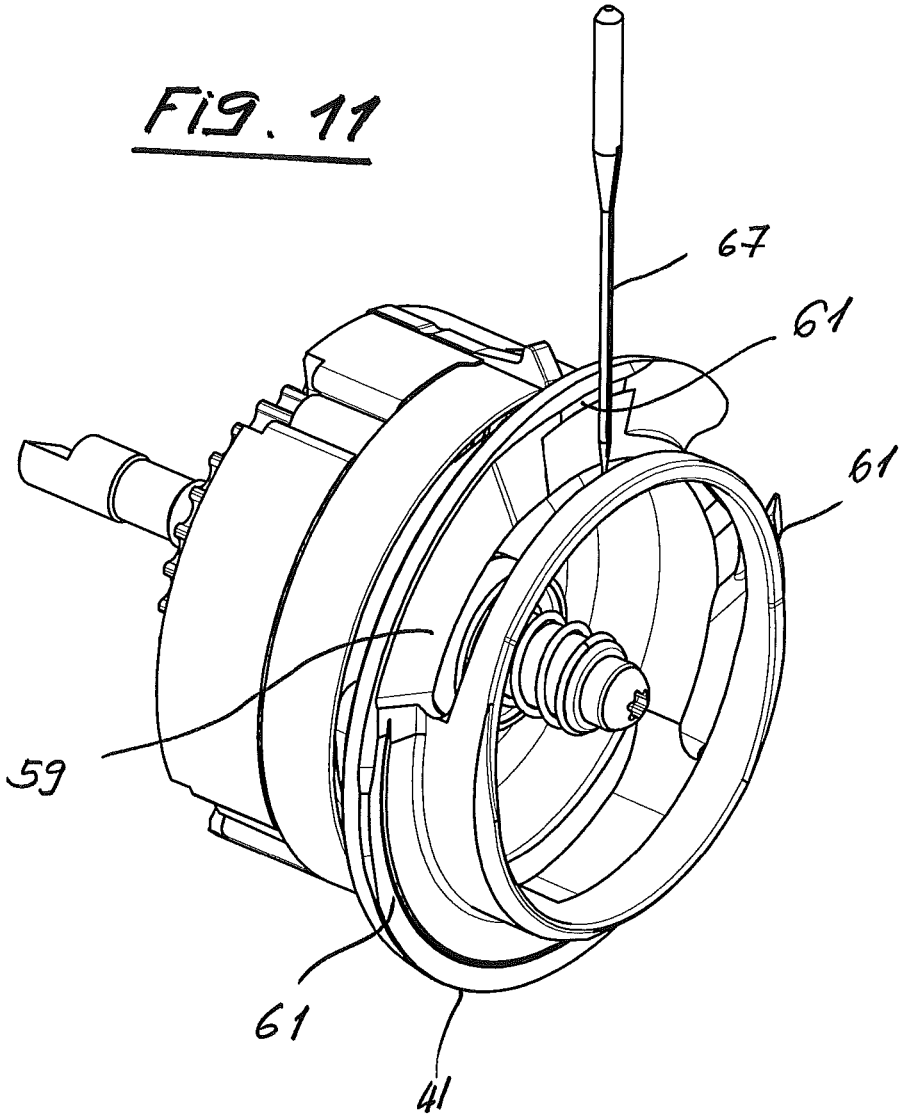
FIG. 11 shows a perspective view of the hook with inserted needle.
Figure 12:
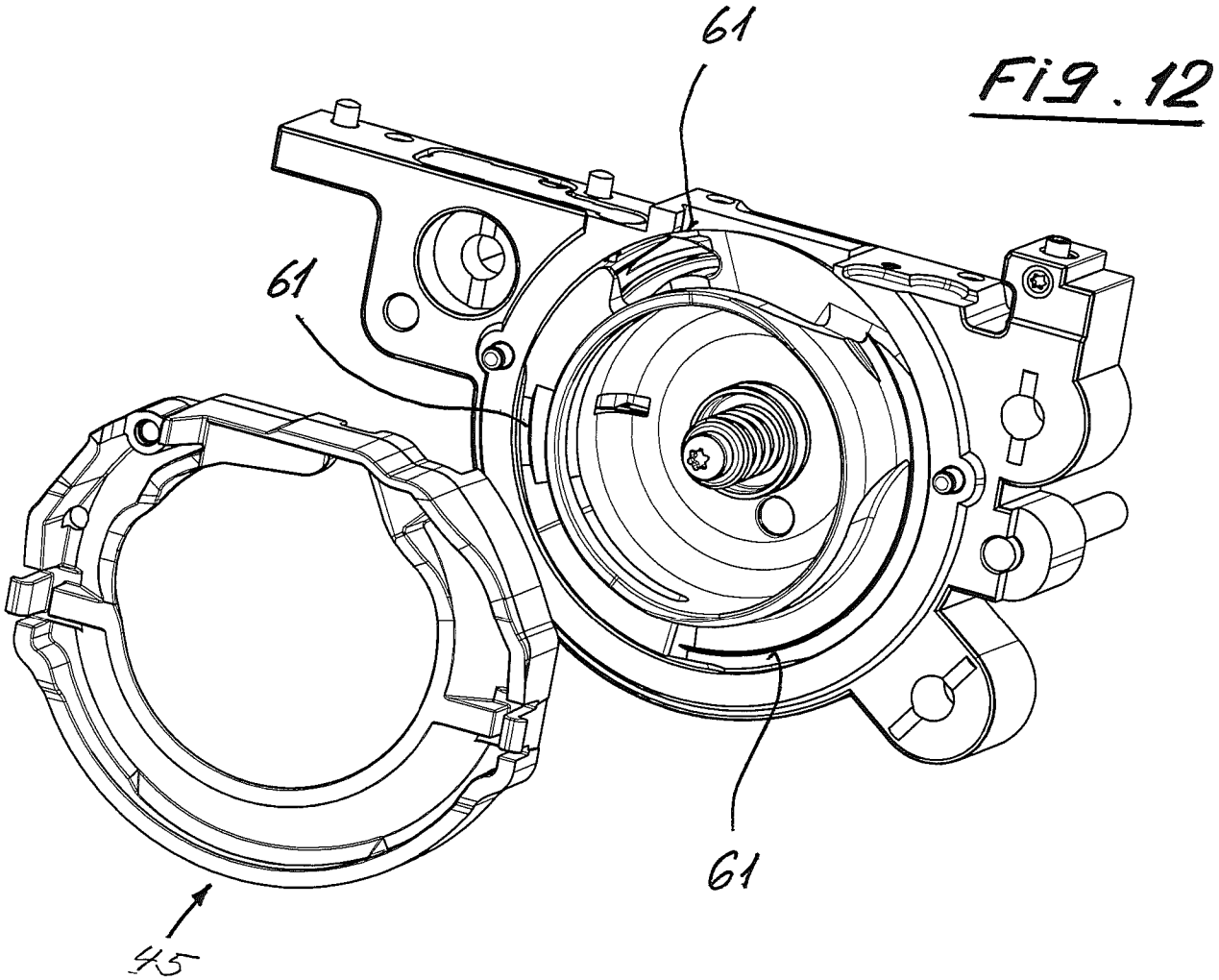
FIG. 12 shows a perspective view of the hook race carrier installed in the machine housing, with hook race cover lifted off.
Figure 13:
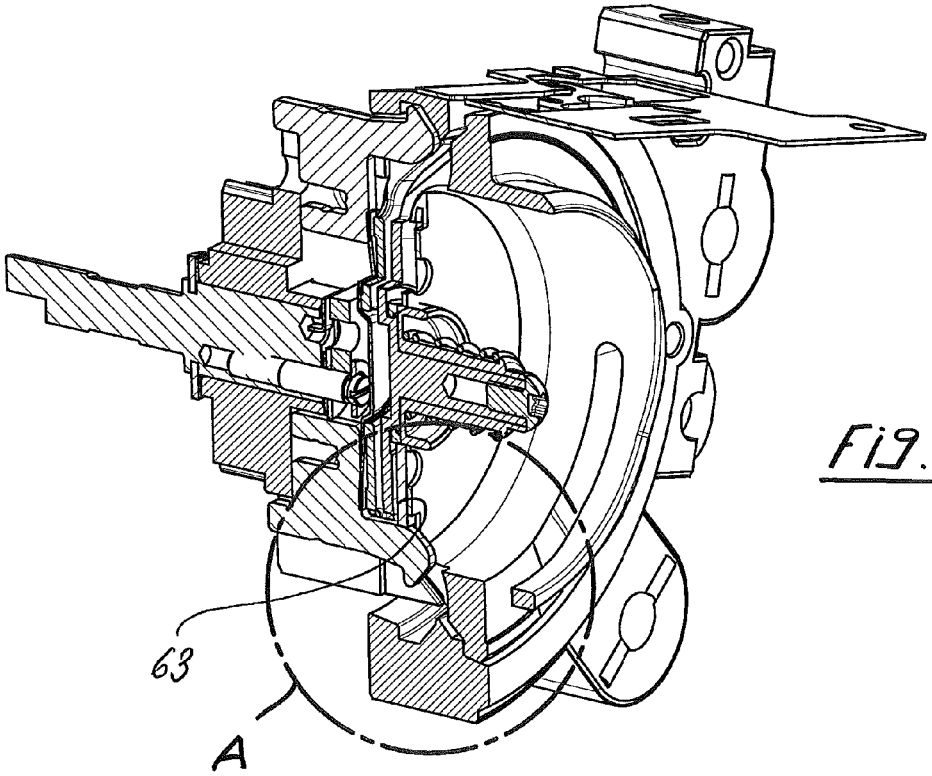
FIG. 13 shows a horizontal section through the hook system with a lubricating element for the drive cams.
Figure 13A:
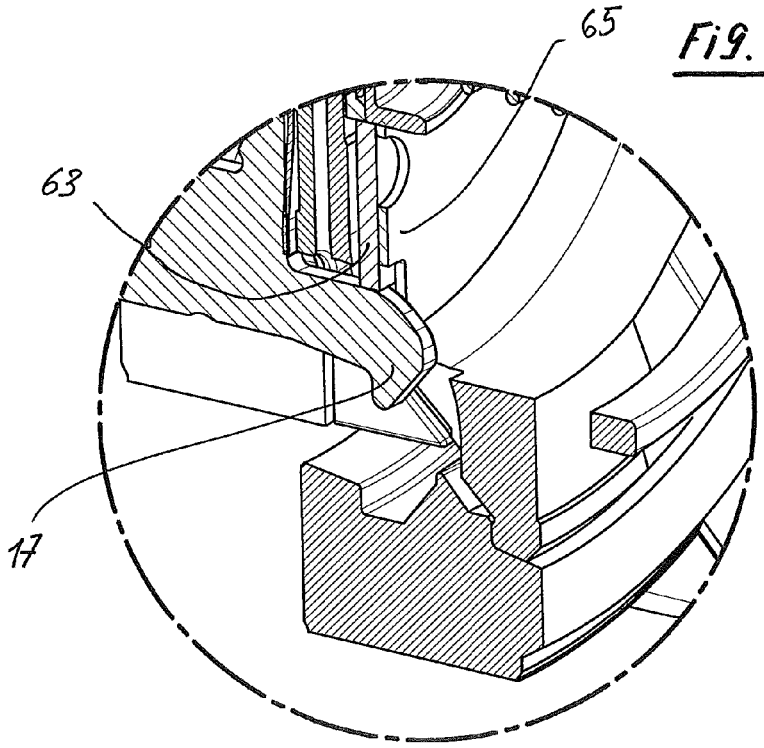
FIG. 13*a* shows an enlargement of segment B in FIG. 13.
Figure 14:
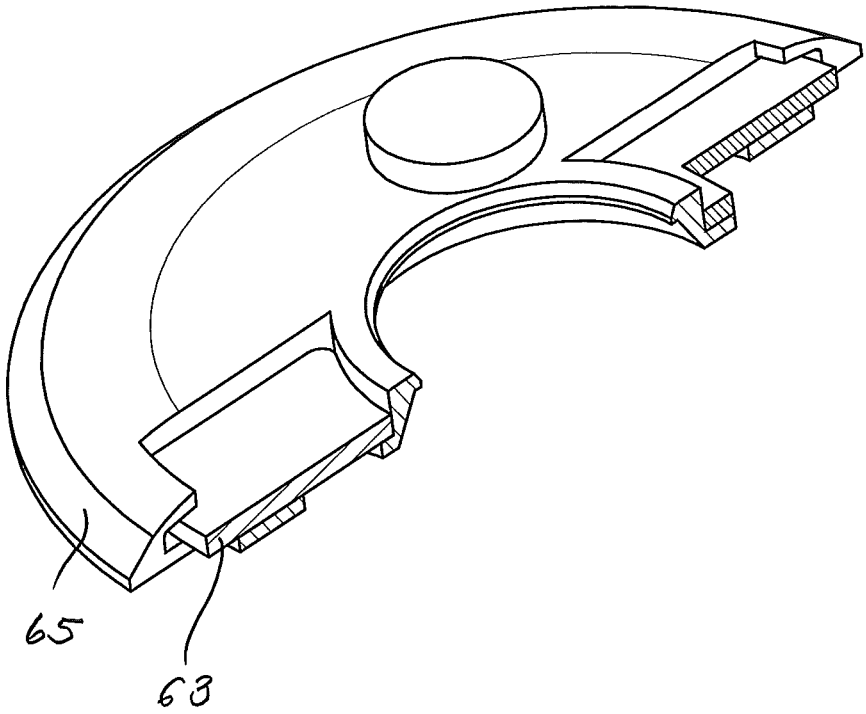
FIG. 14 shows an axial section through a perspective view of a lubricating element.

The hook or guide race 41 expands conically towards the open side, and is made in hook race carrier 7. Likewise, the edge 3 of hook 1 extends conically and is fashioned with the same cone angle. In order to prevent hook 1 from falling out of hook race 41, a magnet system, in the form of one or more magnets 43, can be placed in the guide bearing 21 or in the back of the hook 1 (FIGS. 8 and 9). The magnets 43 hold the hook 1 in position with a small holding force after the operator of the sewing machine has placed the hook into the hook race 41, even if the hook race cover 45 has not yet been put in place. The magnets 43 have the effect that even at high sewing speeds the hook 1 revolves with low noise production.

The hook race cover 45 is mounted so as to be elastically flexible axially, e.g. due to a spring mounting using a spring 47. This makes it possible to easily release a thread 49 clamped between the hook 1 and the hook race 41, by lifting the hook 1 away somewhat from the hook race 41 at the location of the clamping by pulling on the thread 49, so that the clamped thread can be released. Due to this measure, a cutting device on the hook 1 can be omitted, and the handling of a clamped thread 49 is significantly simplified. In other words, the previously required axial pulling out of the hook 1 from the hook race 41 can be avoided simply by pulling on the thread 49. For this purpose, the forces of the magnets 43 and of the spring 47 are matched to the machine drive.

Due to the conical construction of the hook race 41, the placing of the hook 1 into the guide race 41 is also significantly simpler than is the case given a cylindrical hook race. The hook 1 cannot become tilted, and therefore cannot become stuck, in the hook race 5.

At least two ramps 61 are fashioned on an annular surface 59 that is situated perpendicular to the axis of rotation of the hook 1, connected to the hook race 41. These ramps extend over an angular range on annular surface 59. The ramps 61 are situated over the slots 23 through which the drive cams 17 engage in the hook back 14.

The ramps 61 prevent the hook 1 from pivoting out of its situation coaxial to the hook race carrier 7 when the drive cams 17 move into the openings 15; such pivoting could cause the hook to wobble at higher sewing speeds. The ramps 61 deflect the needle 67 minimally from its axis.

As shown in FIG. 2, the bobbin case 11, with the lower thread bobbin 13 placed therein, is seated on a receiving peg 9 and is held thereon by suitable locking means (not shown). A braking force is exerted on the bobbin 13 by a brake spring 51, known from the prior art, that lies frictionally against the bobbin 13 and is fastened on the base of the bobbin case 11. In this way, an overrun after the termination of each thread pull-off cycle by the thread lifter (the latter is not shown) is dampened. The dampening, or braking, of the bobbin 13 is insufficient in the case of demanding jobs, and in particular high stitch counts. For this reason, according to the present invention, in the base of the bobbin case 11 there is placed a spring wire 53 that runs in the area of the base of the bobbin case 11, preferably in a circular ring shape along the wall of the bobbin case 11, one end 55 of which is bent away at a right angle from the base, running axially to the wall of the bobbin case 11. The bent-up end 55 is situated in the region of a thread exit opening 56 in the bobbin case 11. When the thread pull-off force is increased, the lower thread pulled off from the bobbin 13 tensions the spring wire 53, and thus pulls the bent-up end in a circular path along the periphery of the wall of the bobbin case 11. This reduces the pull-off impulse on the lower thread bobbin 13 and, as soon as the thread pull-off force decreases, the thread, which is still spooling off briefly due to the inertia of bobbin 13, is guided to the side by bent-up end 55 of the spring wire 53. Due to this, the thread running off from the lower thread bobbin 13 remains tensioned with a force that essentially remains approximately constant at all times. The change in the pull-off speed of the thread from the bobbin 13 that occurs upon each stitch is thus smaller, and in addition is at a lower level. The impulse is spread at the working point. In addition, the occurrence of a loose lower thread is reduced.

In the hook race carrier 7, an oil reservoir 57 can be fashioned from which oil can exit onto the hook race 5 in a specifiable quantity in order to bring about a maximally friction-free gliding of the hook 1 on the hook race 5. This additionally reduces the production of noise.

LEGEND OF REFERENCE CHARACTERS

1 Hook
3 Edge
5 Hook race
7 Hook race carrier
9 Receiving peg
11 Bobbin case
13 Lower thread bobbin
14 Back of 1
15 Opening
17 Drive cam
19 Cam support
21 Guide bearing
23 Slot
25 Opening
27 Guide surface
29 Sliding block
31 Bolt
35 Shaft
37 Gear
39 Catch tip
41 Guide race/hook race
43 Magnets
45 Hook race cover
47 Spring
49 Thread
51 Brake spring
53 Spring wire
55 Bent-up end
56 Thread exit opening
57 Oil depot
59 Annular surface
61 Ramps
63 Lubricating element
65 Carrier disc
67 Needle

The invention claimed is:

1. A hook system for a sewing machine, comprising: a hook (1) that is mounted for rotation and is drivable by a hook drive in a hook race (5) of a hook race carrier (7), a bobbin case (11) for a lower thread bobbin (13) is located in the hook (1), a guide bearing (21) for a cam support (19) with at least two drive cams (17) located between the hook drive and the hook (1), the drive cams (17) are displaceably guided on the cam support (19) in the guide bearing (21) that is rotatable by a shaft (35) of the drive, and the cam support (19) is displaceable by a bolt (31) located on the shaft (35) eccentrically to an axis (A) of the shaft (35), a sliding block (29) pushed onto the bolt (31), the sliding block (29) being guided in an opening (25) in the cam support (19) for movement back and forth between two parallel guide surfaces (27), and the sliding block including opposing surfaces upon which the parallel guide surfaces act, the at least two drive cams (17) are displaceable in a radial direction in two slots (23) in the guide bearing (21), the drive cams (17) are driven via the sliding block (29) such that during a rotation of the hook (1), in a first position, each of the drive cams (17) is movably located in a respective one of two openings (15) in a back (14) of the hook (1), entering into a positive connection therewith, and at subsequent rotational positions of the hook, one of the two drive cams (17) are each in a single engagement with the hook in a respective one of the openings (15) and the other of the two drive cams is disengaged from the respective one of the openings in order to allow passage of an upper thread between the hook and the bobbin case.

2. A hook system as recited in claim 1, wherein a peripheral region (41) of the hook race (5) in the hook race carrier (7) and an edge (3) of the hook (1) are fashioned so as to run conically, and the hook (1) is held by a spring-loaded hook race cover (45) on the hook race carrier (7) as an axially acting support element.

3. The hook system as recited in claim 2, wherein ramps (61) are located on annular surfaces arranged perpendicular to an axis of rotation of the hook (1) and connected to the conical peripheral edge (3) of the hook (1), in a region of the slots (23), and the ramps (61) extend over a circular ring-shaped region, said ramps partially reduce a size of an annular intermediate space between the hook (1) and the hook race cover (7).

4. The hook system as recited in claim 3, wherein the ramps each extend over an angular range.

5. The hook system as recited in claim 2, wherein magnets (43) are placed in at least one of the guide bearing (21) or on the hook (1) as holding devices for the hook (1).

6. The hook system as recited in claim 2, wherein the hook race carrier (7) includes an oil reservoir (57) having a bore that opens into the hook race (5) for permanent lubrication or cyclical lubrication of the hook race (5).

7. A hook system for a sewing machine, comprising: a hook (1) that is mounted for rotation and is drivable by a hook drive in a hook race (5) of a hook race carrier (7), a bobbin case (11) for a lower thread bobbin (13) that is insertable in the hook (1), a guide bearing (21) for a cam support (19) with at least two drive cams (17) located between the hook drive and the hook (1), the at least two drive cams (17) are displaceable in a radial direction in two slots (23) in the guide bearing (21), drivable by an eccentric drive, the drive cams (17) are drivable such that during a rotation of the hook (1), in a first position, each of the drive cams (17) enters into a respective one of two openings (15) in a back (14) of the hook (1), entering into a positive connection therewith, and at subsequent rotational positions of the hook, one of the two drive cams (17) are each in a single engagement with the hook in a respective one of the openings (15) and the other of the two drive cams is disengaged from the respective one of the openings in order to allow passage of an upper thread between the hook and the bobbin case, and in the bobbin case (11) there is situated a thread-deflecting spring wire (53) having a shape of a circular arc, with a first end fixedly connected to the bobbin case (11) and a second end (55) situated to extend essentially axially to an inner peripheral wall of the bobbin case (11), and being pivotable by the lower thread (49) in a thread pull direction for at least one of an increased pull-off speed or an increased pull-off force.

8. A hook system for a sewing machine, comprising: a hook (1) that is mounted for rotation and is drivable by a hook drive in a hook race (5) of a hook race carrier (7), a bobbin case (11) for a lower thread bobbin (13) that is insertable in the hook (1), a guide bearing (21) for a cam support (19) with at least two drive cams (17) located between the hook drive and the hook (1), the at least two drive cams (17) are displaceable in a radial direction in two slots (23) in the guide bearing (21), drivable by an eccentric drive, the drive cams (17) are drivable such that during a rotation of the hook (1), in a first position, each of the drive cams (17) enters into a respective one of two openings (15) in a back (14) of the hook (1), entering into a positive connection therewith, and at subsequent rotational positions of the hook, one of the two drive cams (17) are each in a single engagement with the hook in a respective one of the openings (15) and the other of the two drive cams is disengaged from the respective one of the openings in order to allow passage of an upper thread between the hook and the bobbin case, and between the guide bearing (21) and the hook (1), at least in a region of the drive cams (17), there is a lubricating element (63) to transfer a lubricant to the drive cams (17).

9. The hook system as recited in claim 8, wherein the lubricating element (63) is fastened in or on a carrier disk (65).

10. The hook system as recited in claim 8, wherein the lubricating element (63) is placed into the hook (1), and upon each advance through the openings (15) the drive cams (17) come into contact with the lubricating element (63).

* * * * *

UNITED STATES PATENT AND TRADEMARK OFFICE

CERTIFICATE OF CORRECTION

PATENT NO. : 8,757,075 B2
APPLICATION NO. : 13/415075
DATED : June 24, 2014
INVENTOR(S) : Severin Brunner et al.

It is certified that error appears in the above-identified patent and that said Letters Patent is hereby corrected as shown below:

On the title page, item (73), after the word "Assignee:", please delete "BENINA" and insert --BERNINA--.

Signed and Sealed this
Twenty-second Day of December, 2015

Michelle K. Lee

Michelle K. Lee
*Director of the United States Patent and Trademark Office*